US011376519B2

(12) United States Patent
Goldbeck

(10) Patent No.: US 11,376,519 B2
(45) Date of Patent: Jul. 5, 2022

(54) NESTABLE STARTING BLOCK

(71) Applicant: Jodi Goldbeck, Middleton, WI (US)

(72) Inventor: Jodi Goldbeck, Middleton, WI (US)

( * ) Notice: Subject to any disclaimer, the term of this patent is extended or adjusted under 35 U.S.C. 154(b) by 68 days.

(21) Appl. No.: 16/990,031

(22) Filed: Aug. 11, 2020

(65) Prior Publication Data

US 2021/0046396 A1 Feb. 18, 2021

Related U.S. Application Data

(60) Provisional application No. 62/885,486, filed on Aug. 12, 2019.

(51) Int. Cl.
*A63K 3/02* (2006.01)

(52) U.S. Cl.
CPC ..... *A63K 3/023* (2013.01)

(58) Field of Classification Search
CPC ..... A63K 3/023; A63B 23/03591; A63B 2230/00; A63B 2225/50; A63B 2225/09; A63B 2225/02; A63B 21/4011; A63B 21/4017; A63B 22/20; A63B 5/00; A63B 26/00
See application file for complete search history.

(56) References Cited

U.S. PATENT DOCUMENTS 3,401,931 A * 9/1968 McCafferty ..... A63K 3/023 482/19
6,494,812 B1 * 12/2002 Grimes, Jr. ..... A63B 5/00 482/14
9,433,813 B1 * 9/2016 Cervantez ..... A63B 21/00047
2007/0219076 A1 * 9/2007 Axelrod ..... A63B 21/00047 482/148

OTHER PUBLICATIONS https://www.dictionary.com/browse/cleat; Jan. 3, 2020; Dictionary.com (Year: 2022).*

* cited by examiner

*Primary Examiner* — Andrew S Lo
*Assistant Examiner* — Andrew M Kobylarz
(74) *Attorney, Agent, or Firm* — Joseph T. Leone, Esq.; DeWitt LLP

(57) ABSTRACT

The present invention is a starter block for use in athletic events. The bottom-surface cleats which anchor the starting block to the ground are associated with blind bores extending through the lower surface. Each cleat has an associated blind bore. The positioning of the blind bores relative to the cleats allow the cleats of one starting block to be received by the blind bores of another starting block, and vice versa. This configuration allows the blocks to be stored easily and safely.

15 Claims, 3 Drawing Sheets

NESTABLE STARTING BLOCK

CROSS-REFERENCE TO RELATED APPLICATIONS

The present application claims priority of U.S. Provisional Patent Application No. 62/885,486, filed on Aug. 12, 2019, the contents of which are incorporated herein by reference in their entirety.

FIELD OF THE INVENTION

The present disclosure is directed to an athletic equipment system, specifically an easily transportable starting block.

BACKGROUND

The sprinting events in the sport of track and field universally begin with the runners crouched in starting blocks. Conventional starting blocks include a central rail extending front-to-back between the runner's legs. Two foot pedals, one for the runner's left foot and the other for the runner's right foot, are movably attached to the central rail. Every runner has his or her own preferred foot placement for achieving a fast start. Thus, prior to a race or practice sprint, a runner will adjust the foot pedals forward or backward along the central rail to his or her preferred footing. More sophisticated starting blocks also include additional adjustment means to adjust the foot pedals inward and outward relative to the central rail to accommodate runners having a narrower or wider stance in the blocks, as well as the angle of the pedals relative to the running surface.

The starting blocks are anchored in some fashion to the running surface. In formal track competitions, either indoor or outdoor, the track events are held on an oval track. The surface of the oval may be made of any number of different materials: grass, clay, synthetic materials, asphalt, cinders, etc. In less formal situations, a sprint or practice run might take place on a typical high school football field or soccer pitch of natural turf. In either situation, the purpose of starting blocks is to give the runner a firm anchor to the ground, against which the runner propels himself from a standstill to a full-on sprint as quickly and forcefully as possible.

The process of starting a sprint from starting blocks, however, takes practice. In such short events, a smooth and powerful start is a key element to success. In the shortest sprint event, the 100-meter dash, even at the high school level, the entire race is over in well under 15 seconds. (The current girls high school record for the 100-meter dash in Wisconsin is 11.38 seconds—Dezerea Bryant, 2011. For boys, the record is 10.33 seconds—Michael Bennet, 1998.) Thus, serious sprint competitors always practice using starting blocks.

Conventional starting blocks, though, are bulky contraptions that are expensive and not easily transportable. Thus, there is a long-felt and unmet need for starting blocks that are inexpensive, easily transportable, and highly functional on the variety of running surfaces typically encountered in track and field events.

BRIEF SUMMARY

One embodiment of the present invention is a starting block with a wedge-shaped body having an upper surface and a lower surface. The upper surface defines an inclined surface with respect to the lower surface. At least one blind bore extends through the lower surface. At least one cleat extends from the lower surface, the cleat being associated with the at least one blind bore. The at least one blind bore and the at least one cleat are dimensioned and positioned relative to each other such that when the wedge-shaped body is rotated from a first position to a second position 180° about a horizontal axis extending across and through a center point of the lower surface, at least a portion of the at least one cleat extends through a location previously occupied in the first position by the at least one blind bore.

Another embodiment of the present invention is a starting block system including a first starting block and a second starting block, the first and second starting block having an identical configuration as described above. When the lower surface of the first starting block contacts the lower surface of the second starting block and the upper surface of the first starting block is parallel to the upper surface of the second starting block, at least a portion of the at least one cleat of the first starting block extends into the at least one blind bore of the second starting block, and at least a portion of the at least one cleat of the second starting block extends into the at least one blind bore of the first starting block.

BRIEF DESCRIPTION OF THE DRAWING(S)

Figure 3:
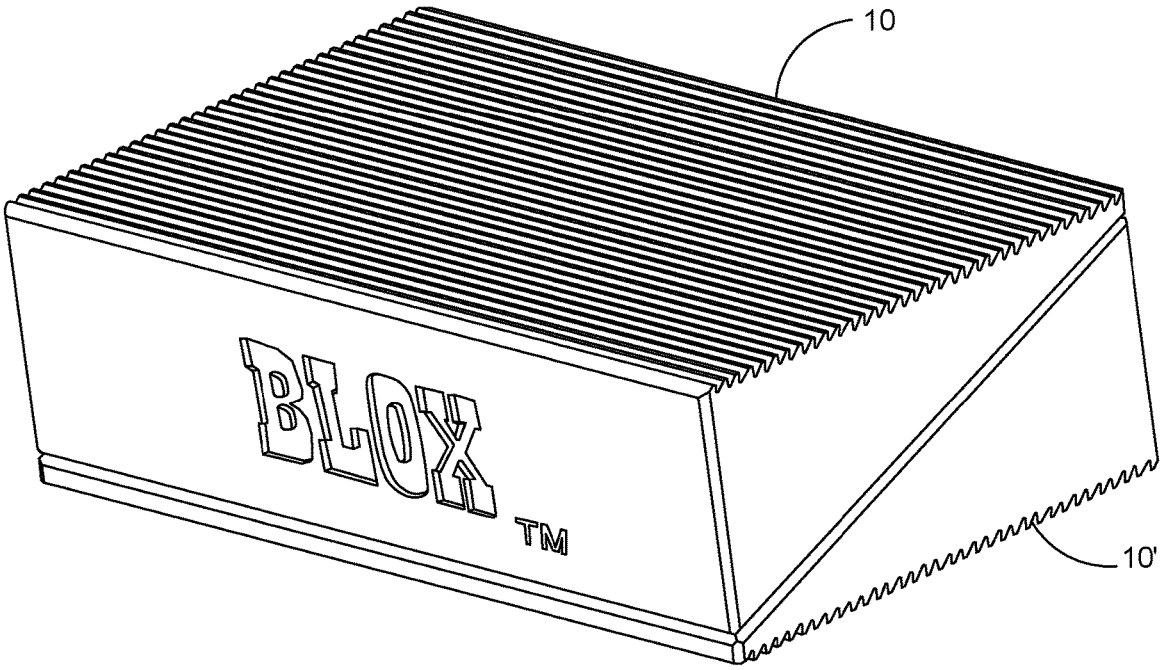
FIG. 3 is a perspective view of a first block 10 nested to a second block 10'.
Figure 4:
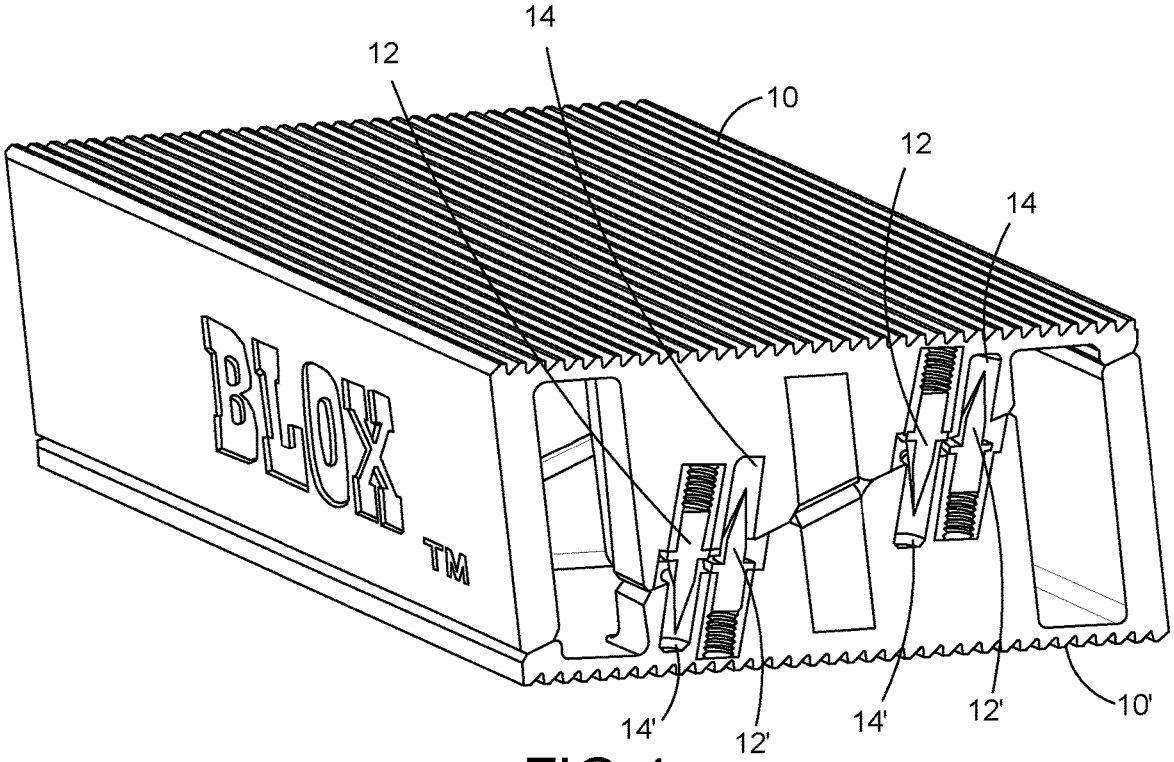

FIG. 4 is a partially cutaway view of FIG. 3 passing through the cleats 12 and 12' and the blind bores 14 and 14' of blocks 10 and 10' (respectively).

Figure 5:
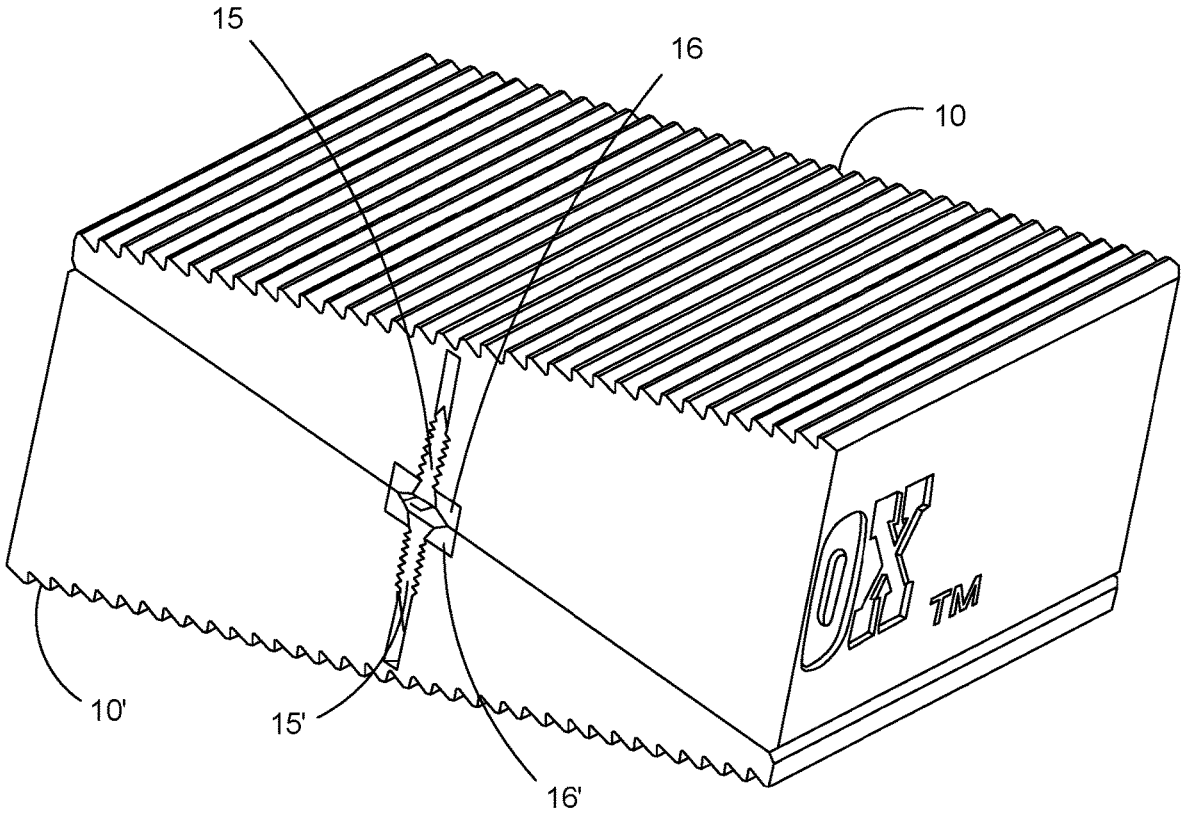

FIG. 5 is a partially cutaway view of FIG. 3 passing through the fasteners 16 and 16' of blocks 10 and 10' (respectively).

The same reference numerals are use throughout the figures to refer to the same elements in each drawing.

DETAILED DESCRIPTION

Figure 1:
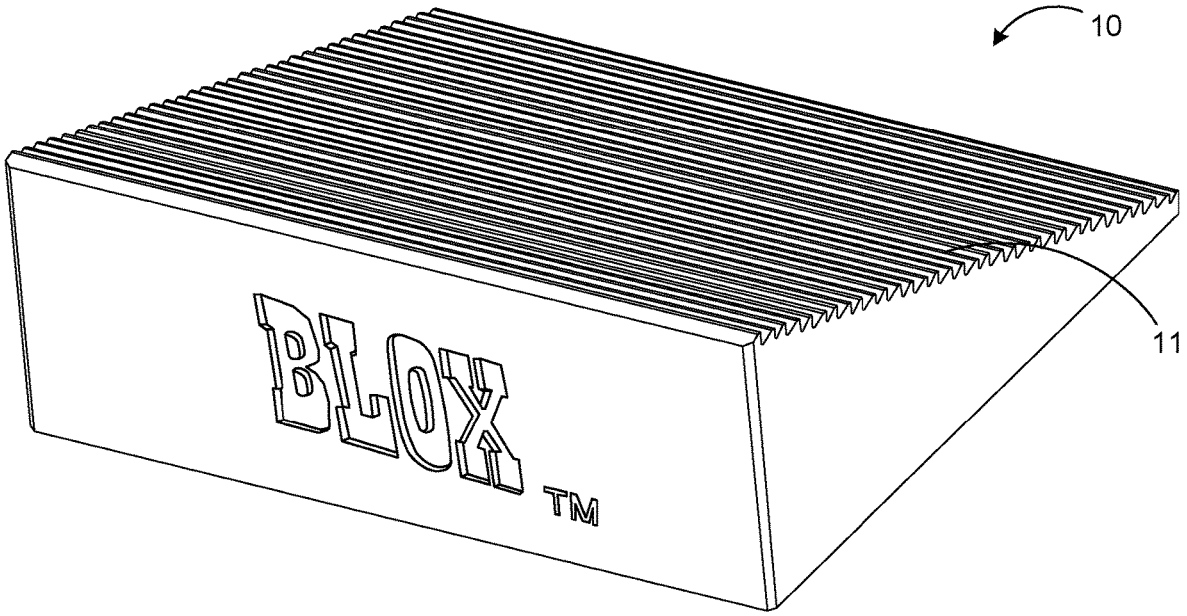
FIG. 1 is an upper right, rear perspective view of a preferred version of the starting block of the invention disclosed and claimed herein.

FIG. 1 shows the visible surfaces of the block 10 when placed on the running surface. The block 10 comprises a wedge-shaped body, and includes an inclined surface 11 at the top onto which a runner places one of his or her feet. A second block, not shown, is used for the other foot. The body of the block 10 may be made from any suitable rigid material, such as plastic, wood, metal, or composite materials, or any combination thereof. As shown in FIG. 1, the inclined surface 11 preferably comprises a stippled, mottled, knurled, grooved, or otherwise roughened surface to give a high-friction, minimal-slip interface between the inclined surface 11 of the block 10 and the runner's shoe. To reduce weight, material, and cost, at least one block hollow 17 may extend into at least part of a lower surface 13 of the block 10. To strengthen the block 10, at least reinforcing rib 18 may extend across the block hollow 17.

Figure 2:
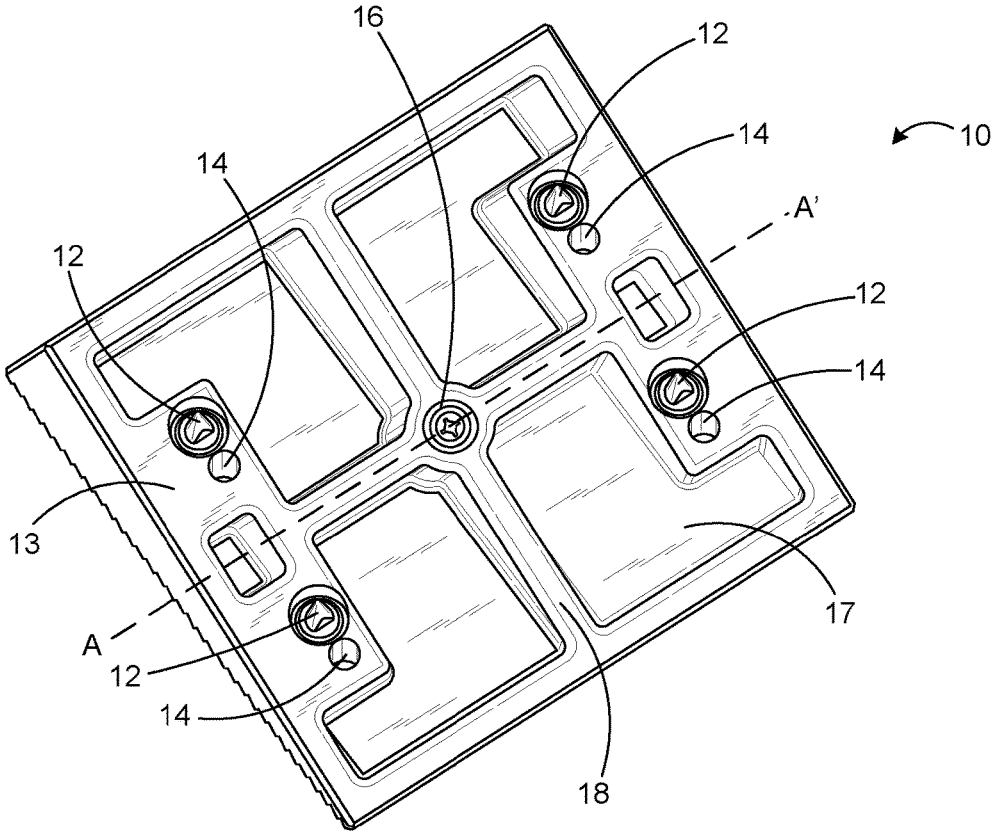
FIG. 2 is a lower, right, front perspective view thereof.

FIG. 2 shows the underside of the block 10. The block 10 includes at least one, and preferably two, three, four, or more cleats 12 extending from the lower surface 13 of the block 10. The cleats 12 may be integrally formed with the block 10 or may be removable, using the threaded, friction-fit, or snap-in type cleat connections conventionally used in cleated shoes (such as the removable cleats found on racing flats, golf shoes, and the like). Removable cleats 12 allow substitution of longer or shorter cleats 12 or cleats 12 having a different anchoring configuration to be installed based on the type and/or conditions of the running surface. By way of non-limiting example, when used on natural surfaces such as turf or clay, longer cleats 12 will anchor the block 10 to the surface more firmly. On closely groomed surfaces or artificial surfaces, shorter cleats 12 might suffice, and would have less potential to mar the running surface.

Each cleat 12 is paired with a corresponding blind bore 14 extending through the lower surface 13. The exemplary embodiment of the block 10 shown in FIG. 2 includes four sets of cleats 12 and corresponding blind bores 14. As described more fully below with respect to FIGS. 3, 4, and 5, the cleats 12 and blind bores 14 are dimensioned, configured, and positioned in such a way that two blocks 10 and 10', rotated at a 180° offset to one another, can be nested together via contacting their lower surfaces 13 and 13' together. In other words, when the block 10 is rotated 180° about the horizontal axis A-A' (as seen extending across and through the center point of the lower surface 13 in FIG. 2) from a first position to a second position, the cleats 12 in the first position are in the same location as the blind bores 14 in the second position. The reverse is also true, that is, in the first position the blind bores 14 are in the same location as the cleats 12 in the second position.

Typically, at least one reversible fastener 16 is located in the center of the lower surface 13 of the block 10. As shown in FIG. 2, the exemplary fastener 16 is a magnetic washer or button held in place by a separate anchor, in this embodiment a threaded screw 15. In other embodiments, the fastener 16 does not require a separate anchor, being held in place via threaded, friction-fit, adhesive, or snap-in connections with the block 10. The fastener 16 may be any reversible fastener now known or developed in the future, such as a male/female friction fastener, a hook-and-loop fastener, a slot-and-tab fastener, any other mechanically interlocking fastener, and the like. The fastener 16 is dimensioned and configured to reversibly connect two blocks 10 together in face-to-face orientation via their lower surfaces 13 and hold them in such a configuration.

The nested and fastened configurations are depicted in FIGS. 3, 4 and 5, which shall be described together. As shown in FIG. 3, two blocks according to the present disclosure, a first block 10 and a second block 10', are rotated 180° relative to each other and stacked in face-to-face orientation via their respective lower surfaces 13 such that their upper, inclined surfaces 11 are parallel to each other. As shown in the partial cutaway view of FIG. 4, the cleats 12 and blind bores 14 are configured in such a fashion that cleats 12 of the first block 10 extend into the blind bores 14' of the second block 10'. Likewise, the cleats 12' of the second block 10' extend into the blind bores 14 of the first block 10. In this fashion, the two blocks, 10 and 10' can be nested together in a very compact configuration, without any of the cleats 12 being exposed, preventing damage to the cleats 12 and preventing the cleats 12 from causing damage. The exemplary two blocks 10 and 10' are then reversibly held together in the nested configuration via fasteners 16 and 16' as shown in the center, partial cutaway view depicted in FIG. 5.

Any version of any device element or system component or method step of the invention may be used with any other device element, system component, or method step of the invention. The device elements, system components, and method steps described herein can be used in any combination whether explicitly described or not.

As used herein, the singular forms "a," "an," and "the" include plural referents unless the content clearly dictates otherwise. Numerical ranges as used herein are intended to include every number and subset of numbers contained within that range, whether specifically disclosed or not. Further, these numerical ranges should be construed as providing support for a claim directed to any number or subset of numbers in that range. For example, a disclosure of from 1 to 10 should be construed as supporting a range of from 2 to 8, from 3 to 7, from 5 to 6, from 1 to 9, from 3.6 to 4.6, from 3.5 to 9.9, and so forth.

All patents, patent publications, patent applications, and peer-reviewed publications (i.e., "references") cited herein are expressly incorporated by reference in their entirety to the same extent as if each individual reference were specifically and individually indicated as being incorporated by reference. In case of conflict between the present disclosure and the incorporated references, the present disclosure controls.

The devices, methods, compounds and compositions of the present invention can comprise, consist of, or consist essentially of the essential elements and limitations described herein, as well as any additional or optional steps, ingredients, components, or limitations described herein or otherwise useful in the art.

While this invention may be embodied in many forms, what is described in detail herein is a specific preferred embodiment of the invention. The present disclosure is an exemplification of the principles of the invention is not intended to limit the invention to the particular embodiments illustrated. It is to be understood that this invention is not limited to the particular examples, process steps, and materials disclosed herein as such examples, process steps, and materials may vary somewhat. It is also understood that the terminology used herein is used for the purpose of describing particular embodiments only and is not intended to be limiting since the scope of the present invention will be limited to only the appended claims and equivalents thereof.

What is claimed is:

1. A starting block comprising a wedge-shaped body having an upper surface and a lower surface, wherein the upper surface defines an inclined surface with respect to the lower surface;

at least one blind bore extending through the lower surface;

at least one cleat associated with the at least one blind bore, the cleat extending from the lower surface;

wherein the at least one blind bore and the at least one cleat are dimensioned and positioned relative to each other such that when the wedge-shaped body is rotated from a first position to a second position 180° about a horizontal axis extending across and through a center point of the lower surface, at least a portion of the at least one cleat extends through a location previously occupied in the first position by the at least one blind bore.

2. The starting block of claim 1, wherein the inclined surface comprises a roughened surface.

3. A starting block comprising a wedge-shaped body having an upper surface and a lower surface, wherein the upper surface defines an inclined surface with respect to the lower surface;

at least one blind bore extending through the lower surface;

at least one cleat associated with the at least one blind bore, the cleat extending from the lower surface;

wherein the at least one blind bore and the at least one cleat are dimensioned and positioned relative to each other such that when the wedge-shaped body is rotated from a first position to a second position 180° about a horizontal axis extending across and through a center point of the lower surface, at least a portion of the at least one cleat extends through a location previously occupied in the first position by the at least one blind bore;

wherein the lower surface comprises at least one block hollow forming a depression in the lower surface.

4. The starting block of claim 3, wherein the at least one cleat is removable from the lower surface.

5. The starting block of claim 4, wherein the at least one cleat is connected to the lower surface by a threaded, friction-fit, or snap-in connection.

6. The starting block of claim 3, wherein the lower surface comprises at least one reinforcing rib extending across the at least one block hollow.

7. The starting block of claim 3, wherein the at least one cleat is integrally formed with the lower surface.

8. A starting block system, comprising:

a first starting block and a second starting block, the first starting block and the second starting block having an identical configuration, each comprising:

a wedge-shaped body having an upper surface and a lower surface, wherein the upper surface defines an inclined surface with respect to the lower surface;

at least one blind bore extending through the lower surface;

at least one cleat associated with the at least one blind bore, the cleat extending from the lower surface;

wherein when the lower surface of the first starting block contacts the lower surface of the second starting block and the upper surface of the first starting block is parallel to the upper surface of the second starting block, at least a portion of the at least one cleat of the first starting block extends into the at least one blind bore of the second starting block, and at least a portion of the at least one cleat of the second starting block extends into the at least one blind bore of the first starting block.

9. The starting block system of claim 8, further comprising at least one reversible fastener connected to the lower surface of the first starting block and at least one reversible fastener connected to the lower surface of the second starting block.

10. The starting block system of claim 9, wherein the at least one reversible fastener of the first starting block forms a reversible connection with the at least one reversible fastener of the second starting block.

11. A starting block comprising a wedge-shaped body having an upper surface and a lower surface, wherein the upper surface defines an inclined surface with respect to the lower surface;

at least one blind bore extending through the lower surface;

at least one cleat associated with the at least one blind bore, the cleat extending from the lower surface;

wherein the at least one blind bore and the at least one cleat are dimensioned and positioned relative to each other such that when the wedge-shaped body is rotated from a first position to a second position 180° about a horizontal axis extending across and through a center point of the lower surface, at least a portion of the at least one cleat extends through a location previously occupied in the first position by the at least one blind bore; and further comprising at least one reversible fastener connected to the lower surface of the starting block.

12. The starting block of claim 11, wherein the reversible fastener is connected to the lower surface of the starting block by a separate anchor.

13. The starting block of claim 11, wherein the reversible fastener is connected to the lower surface of the starting block by a threaded, friction-fit, adhesive, or snap-in connection.

14. The starting block of claim 11, wherein the reversible fastener is magnetic.

15. The starting block of claim 11, wherein the reversible fastener is a male/female friction fastener, a hook-and-loop fastener, a slot-and-tab fastener, or a mechanically interlocking fastener.

* * * * *